US005090562A

United States Patent [19]

Grullemans

[11] Patent Number: 5,090,562

[45] Date of Patent: Feb. 25, 1992

[54] PROTECTIVE CASE FOR PORTABLE SOUND-PLAYING DEVICE

[76] Inventor: Winslow C. Grullemans, Road #1-216, Williamsburg, Mass. 01096

[21] Appl. No.: 690,076

[22] Filed: Apr. 23, 1991

[51] Int. Cl.[5] ..... B65D 85/00; A47B 81/06

[52] U.S. Cl. ..... 206/320; 220/335; 312/7.1; 312/237; 312/244; 312/255; 312/290; 312/300; 358/254

[58] Field of Search ..... 312/7.1, 7.2, 237, 240, 312/244, 255, 214, 290, 300; 206/305, 320; 220/335; 358/254; 455/351

[56] References Cited

U.S. PATENT DOCUMENTS

| | | | |
|---|---|---|---|
| Re. 33,402 | 10/1990 | Thrush | 206/320 X |
| 1,731,325 | 10/1929 | Stevens | 312/300 X |
| 2,560,335 | 7/1951 | Ericson | 312/290 X |
| 2,577,528 | 12/1951 | Kennedy | 312/7.1 |
| 2,739,863 | 3/1956 | Ferris | 312/290 X |
| 2,746,824 | 5/1956 | Bond | 312/7.1 |
| 3,081,807 | 3/1963 | Lightburn | 206/320 |
| 3,162,813 | 12/1964 | Piccinini | 312/7.1 X |
| 3,190,708 | 6/1965 | Trimnal | 312/255 X |
| 3,294,905 | 12/1966 | Jonassen | 358/254 |
| 3,572,873 | 3/1971 | Harting, Jr. | 312/7.1 X |
| 4,398,212 | 8/1983 | Serry et al. | 312/7.2 X |
| 4,458,813 | 7/1984 | Tushinsky et al. | 206/320 |
| 4,658,956 | 4/1987 | Takeda et al. | 206/320 |

FOREIGN PATENT DOCUMENTS

| | | | |
|---|---|---|---|
| 1063660 | 8/1959 | Fed. Rep. of Germany | 312/7.1 |
| 2835906 | 2/1980 | Fed. Rep. of Germany | 206/320 |

*Primary Examiner*—Bryon P. Gehman
*Attorney, Agent, or Firm*—Darby & Darby

[57] ABSTRACT

A protective case for shipping and for using in place therein a portable sound-playing device such as an audio or video unit, forms a housing resembling a rectangular box whose top side has an opening closed by a cover hinged at its rear edge to the housing for pivoting upwardly and rearwardly to an open position to insert the device, and whose front side has an opening closed by a cover hinged at its bottom edge to the housing for pivoting forwardly and downwardly and then rearwardly and upwardly to a self-storing position parallel to the housing bottom side and in which a protrusion on the cover releasably engages a recess in the bottom side, for unhindered sound transmission from the device via the front opening. The free edges of the top and front covers inter-engage to form a closure seam when the covers are closed, and moisture-impeding edge-sealing formations along the openings and one of the free edges forming the seam seal the covers to the housing and to each other when closed. Resilient shock-absorbing pads adjustably space the device inwardly of the housing interior wall, and an acoustically-transparent screen in the front opening prevents entry of dirt during use when the front cover is self-stored and the top cover is closed.

18 Claims, 3 Drawing Sheets

PROTECTIVE CASE FOR PORTABLE SOUND-PLAYING DEVICE

FIELD AND BACKGROUND OF THE INVENTION

The present invention relates to a protective case for a sound-playing device, and more particularly to a protective case for shipping and for using in place therein a portable sound-playing device such as an audio or video unit.

Portable sound-playing devices such as audio or video units, including radios, e.g. stereo units, TV sets, stereo/video units, etc., are generally provided in a form enclosed in a relatively fragile case. Most controls for these units protrude from the case and are easily broken or knocked out of adjustment during transport or use. Their internal components are easily thrown out of adjustment or broken by minor mishap. The units are exposed to dust and rain in normal use, e.g. at a workplace, beach, block party, picnic, etc., and often become inoperable.

Cases with access doors or covers are known for housing or transporting various items, but their constructions are generally complicated, heavy, expensive and/or of limited utility. They do not provide a sealed condition when closed, nor a front cover arranged for pivoting through an angle of about 270 degrees to a flat flush or parallel relation with the bottom side of the case.

U.S. Pat. No. 536,098 (W. Roberts) shows an apparently wall mounted file case with a vertical rear recess and a vertical front cover hinged by a floating hinge at its bottom to a plate that moves upwardly into the recess when the cover is lowered to a horizontal position and arms swing out to support it as a desk. The cover can be further moved from the horizontal position upwardly into the recess. The case has an unrelated top door.

U.S. Pat. No. 628,041 (Schoenleber) shows a hat box with hinged top and front covers. The front cover is hinged above the front bottom corner of the box and cannot pivot under the box.

U.S. Pat. No. 695,202 (French) shows a travel case with a central rear hinge to open it into top and bottom halves. The front of the top half has an end flap-containing half door hinged at the front top corner to remove a tray without opening the case. Tray strips bear on case interior strips to mount the tray like a drawer. The hinges are arranged for only limited angle pivoting of the case halves and of the half door.

U.S. Pat. No. 1,137,579 (Cohn) shows a valise with a pitched roof top portion whose rear roof side is hinged at the base of the roof portion to open rearwardly about 90 degrees, and whose front roof side and front side therebelow are connected together to open forwardly about 90 degrees via a hinge at the front bottom corner of the valise, for access to trays therein.

U.S. Pat. No. 1,246,203 (Willman) shows a carrying case with a top cover for a typewriter on a tray that slides out for use, and a front cover for a cabinet below the tray. The covers overlap when closed, and internal projections on the top cover hold the typewriter in place. The top cover is hinged at the rear top corner, but the front cover is hinged on the bottom side rearwardly of the front bottom corner so that it hangs down at the front corner of a support for the case when using the typewriter. The front cover cannot pivot to a flat flush or parallel relation with the bottom side of the case.

U.S. Pat. Re. No. 16,442 (McArdle) shows an electric iron case with a top cover hinged at its rear top corner and a front cover hinged at its front bottom corner that meet at its front top corner. Internal and external bosses on the front cover allow its use as a stand for the iron when the case is on a support and the top cover is lowered to a horizontal position. The case is perforated for cooling the iron when enclosed therein after use. The front cover hinge is recessed within the confines of the front bottom corner, and this recessed hinge location and the bosses on the front cover prevent it from being placed in a flat flush or parallel relation with the bottom side of the case.

U.S. Pat. No. 1,731,325 (Stevens) shows a toy chest with a top cover hinged forwardly of its rear top corner and a front cover hinged above its front bottom corner. The front cover hinge location prevents the front cover from pivoting under the chest.

U.S. Pat. No. 1,884,325 (Sommer) shows a cabinet supported on legs and housing a radio and other articles. The cabinet has a top cover hinged to its rear top corner and a pair of front doors hinged to its opposed vertical side corners. The cover and doors do not meet and are arranged for only limited angle pivoting.

U.S. Pat. No. 2,191,729 (H. Roberts) shows a phonograph cabinet with a top door hinged to its rear top corner and a front door hinged to one of its vertical side corners. The doors do not meet and are arranged for only limited angle pivoting.

U.S. Pat. No. 2,560,335 (Ericson) shows a projector carrying case, with a top cover hinged to its rear top corner and a front cover hinged above its front bottom corner so that the front cover cannot pivot under the case.

U.S. Pat. No. 2,662,989 (Thatcher) shows a portable cabinet supported on legs, and having a top cover hinged to its rear top corner and a front cover hinged to its front bottom corner. The covers are arranged for only limited angle pivoting to an open horizontal position for forming a stepped tier table.

U.S. Pat. No. 2,739,863 (Ferris) shows a portable graphic arts work chest with a top cover hinged to its rear top corner and a front cover hinged to its bottom side rearwardly of its front bottom corner but removable for use as a drawing board. The front cover is not arranged for pivoting to a flat flush or parallel relation with the bottom side of the chest, and such would expose its drawing board surface to damage.

U.S. Pat. Nos. 4,658,298 and 4,658,956 (Takeda et al) commonly show a portable case for a TV and a video recorder arranged side by side therein, with a top cover hinged to its rear top corner and a front cover hinged to its front bottom corner. The units abut the case wall which has exposed speaker and power cord apertures, so that the case cannot seal out moisture and dirt and the units are not protected from impact damage. The front cover has a carrying handle that prevents it from being arranged in a flat flush or parallel relation with the bottom side of the case.

A need exists for a protective case for shipping and for using in place therein a portable sound-playing device such as an audio or video unit, at reduced risk of damage to the device from impact and from moisture and dirt, yet which permits unhindered use of the device while normally protecting it from dirt.

SUMMARY OF THE INVENTION

It is an object of the invention to overcome prior art drawbacks, and to provide a protective case for shipping and for using in place therein a portable sound-playing device such as an audio or video unit, that reduces the risk of damage from impact and from moisture and dirt, yet which permits unhindered use of the device in the case while normally protecting it from dirt.

It is another object of the invention to provide such a case which is simple and inexpensive in construction, readily fabricated, and robust, rugged and long wearing in use.

According to the invention, a protective case for shipping and for using in place therein a portable sound-playing device such as an audio or video unit is provided, comprising a box like housing, i.e. a housing resembling a rectangular box, having a front side, a rear side, a top side, a bottom side and opposed lateral sides forming a hollow interior adapted to receive protectively such a portable sound-playing device.

The top side has a top opening between the lateral sides that is closed by a top cover, the bottom side has an external recess, and the front side has a front opening between the lateral sides that is closed by a front cover.

The top cover has a front edge and a rear edge, the front edge defining a free edge and the rear edge being hinged to the housing adjacent the rear side to pivot the top cover from a closed position upwardly and rearwardly to an open position, to insert the said device into the interior.

The front cover has an external protrusion releasably engageable in the recess in the bottom side, and further has a top edge and a bottom edge, the top edge defining a free edge and the bottom edge being hinged to the housing adjacent the bottom side to pivot the front cover from a closed position forwardly and downwardly and then rearwardly and upwardly, i.e. about 270 degrees, to a self-storing position generally parallel to the bottom side and in which the protrusion engages the recess, for unhindered sound transmission from the said device via the front opening.

The protrusion is desirably arranged for friction-fit engagement with the recess. The recess may be a longitudinal groove and the protrusion may be a counterpart longitudinal ridge.

The free edge of the top cover and the free edge of the front cover are arranged for interengagement to form a closure seam when the covers are in the closed position, and moisture-impeding edge-sealing formations are disposed along the top opening, front opening and one of the free edges forming the seam to seal the covers to the housing and to each other when in the closed position.

In particular, the hollow interior of the housing is defined by a perimetric enclosing wall, and resilient seating means are provided for adjustably resiliently seating the said device in inwardly spaced relation to the wall. The seating means may include resilient shock-absorbing pressure pads of selective thickness interposable between the enclosing wall and the said device, and individual shim elements to adjust the thickness of the pads. The top cover may have an internal counterpart resilient seating means for resilient shock-absorbing pressure contact with the adjacent top portion of the said device when the top cover is closed.

A dirt-impeding acoustically-transparent screen, such as an impact grill covered by an acoustically-transparent screening fabric, may be arranged in the front opening to impede entry of dirt when the front cover is in self-storing position and the top cover is in the closed position. The screen may be removably positioned in the front opening and in recessed relation to the front cover when in the closed position, e.g. by pivotally mounting the screen in the opening to pivot from an upright closed position forwardly and downwardly to an open position for access to the interior when the cover is in self-storing position.

The housing may have a retractable antenna and releasable connector means for electrically connecting such antenna to an intact antenna on the device said. Retractable legs, such as telescopically selectively extendible legs, may be provided on the housing to position it in elevated relation to a support surface.

BRIEF DESCRIPTION OF THE DRAWINGS

Other objects of the invention will become apparent from the within specification and accompanying drawings, in which.

DESCRIPTION OF THE PREFERRED EMBODIMENTS

Figure 1:
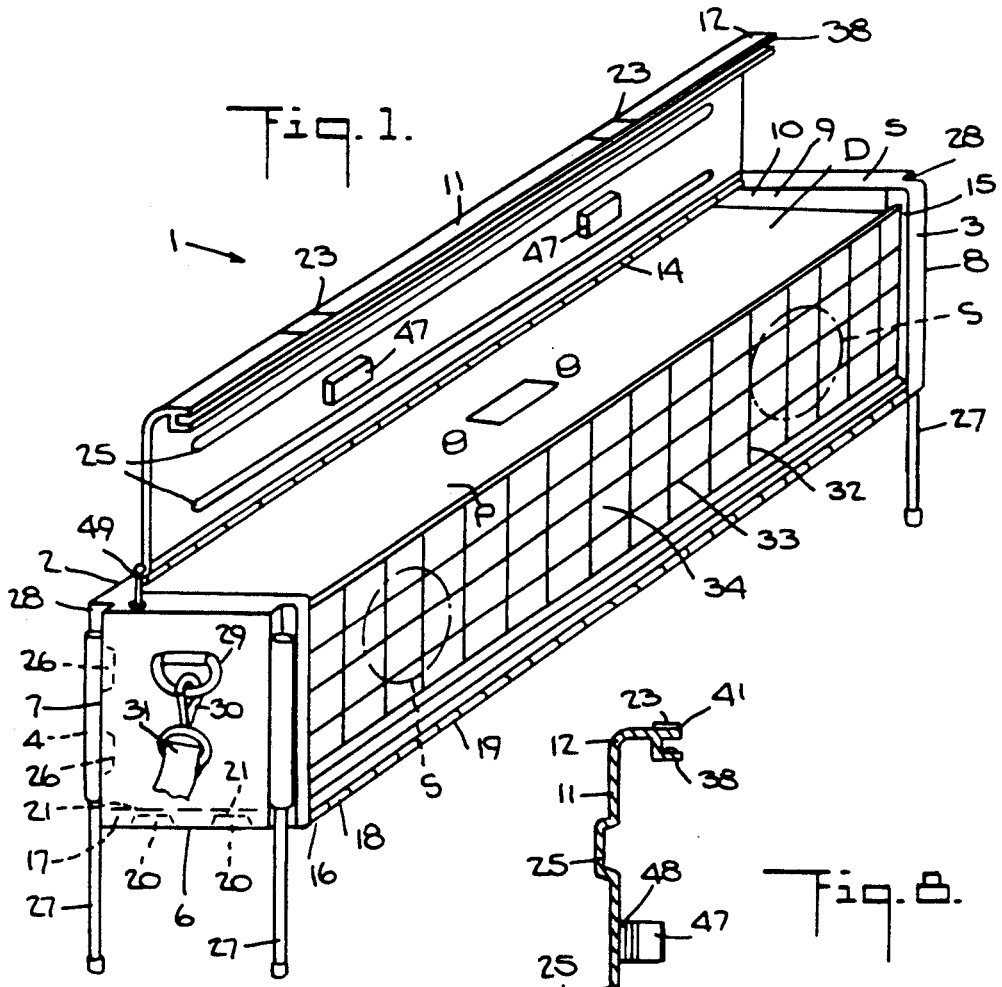
FIG. 1 is a perspective view of the protective case of the invention, with the front cover in self-stored position, and the top cover in an open position to show a contained portable sound-playing device in the form of a radio.

Referring to the drawings, and initially to FIGS. 1–6, a protective case 1 is shown, for shipping and for using in place therein a portable sound-playing device D, such as an audio or video unit, illustrated as a radio, with a panel P of controls C on its top side (FIG. 1) and one or more speakers S (shown in phantom in FIGS. 1 and 5) on its front side. Case 1 has a box like housing 2, i.e. a housing resembling a rectangular box, as shown, with generally flat planar sides, including longitudinal front side 3, rear side 4, top side 5 and bottom side 6, and opposed left and right lateral sides 7 and 8, that form a hollow interior 9 of selective shape and size to receive protectively device D.

Top side 5 has a top opening 10 between lateral sides 7, 8 that is closed by a top cover 11, top cover 11 having a front edge defining a free edge 12 and a rear edge 13 connected by a top hinge 14 to housing 2 adjacent rear side 4. Top cover 11 pivots from a closed position (FIGS. 2–4) upwardly and rearwardly to an open position (FIGS. 1, 5 and 6) for inserting device D into interior 9.

Figure 2:
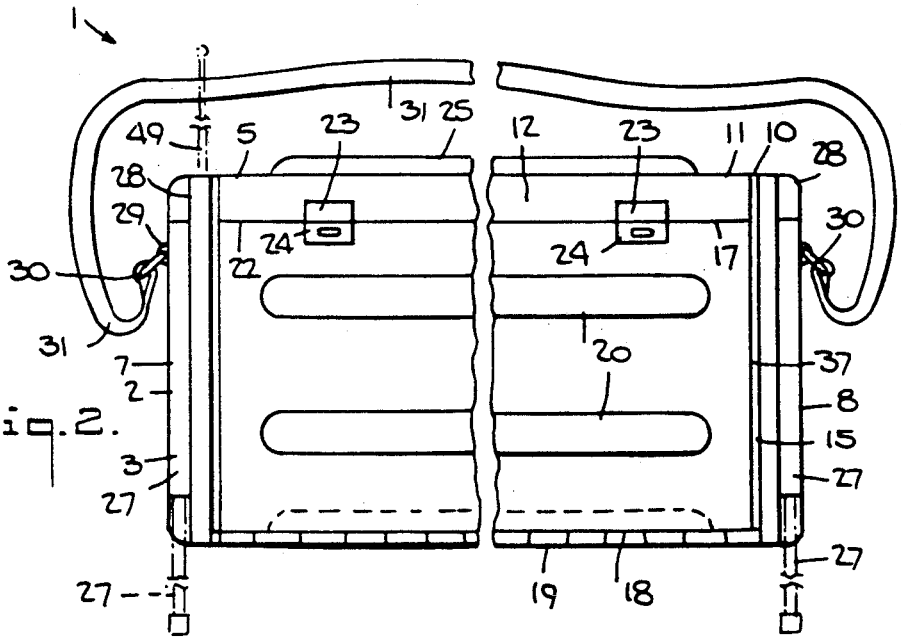
FIG. 2 is a front view of the closed case.
Figure 3:
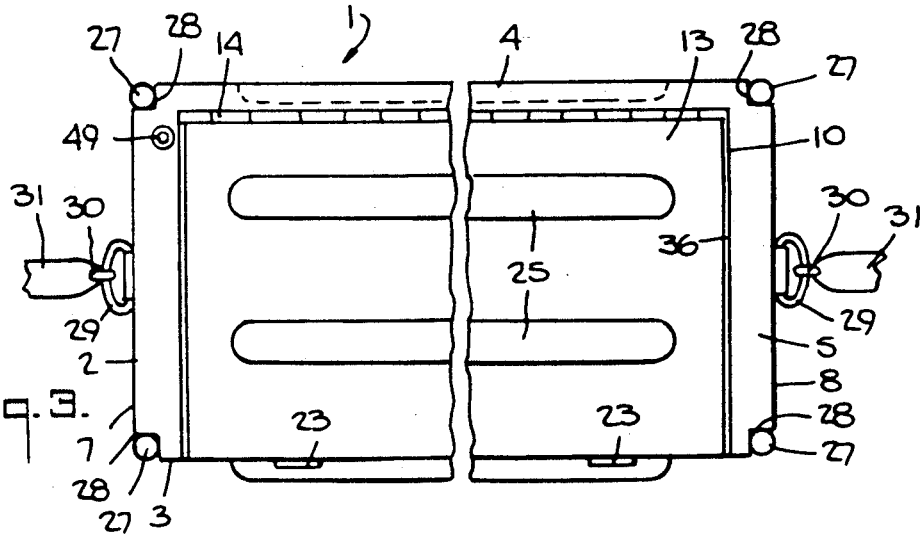
FIG. 3 is a top view of the closed case.
Figure 4:
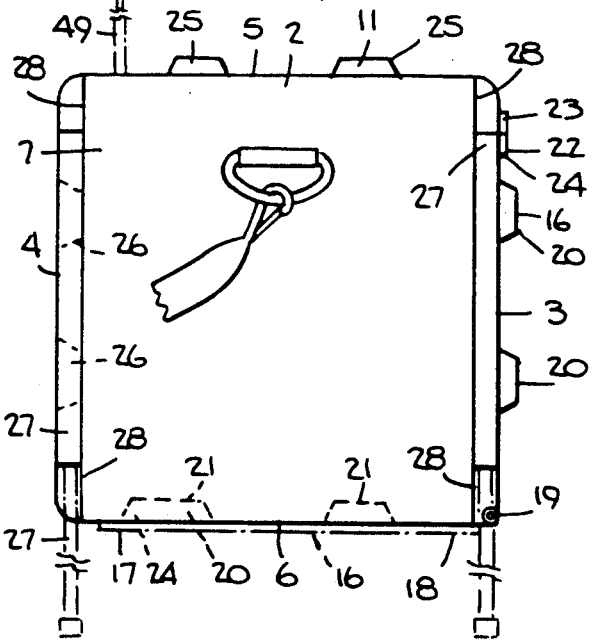
FIG. 4 is a left side view of the closed case.

Front side 3 has a front opening 15 between lateral sides 7, 8 that is closed by a front cover 16 having a top free edge 17 and a bottom edge 18 connected by a front hinge 19 to housing 2 adjacent bottom side 6. Front cover 16 pivots from a closed position (FIGS. 2–4)

forwardly and downwardly and then rearwardly and upwardly to self-storing position generally parallel to bottom side 6 (FIGS. 1 and 5), to permit unhindered sound transmission from speakers S of device D via front opening 15.

For this purpose, front cover 16 has one or more external protrusions 20 shaped and sized to engage releasably, e.g. by friction-fit, one or more counterpart external recesses 21 in bottom side 6. Protrusions 20 form integral longitudinal convex ribs or ridges on front cover 16 and recesses 21 form coacting integral longitudinal concave ribs or grooves on bottom side 6 that are located for precise registry with protrusions 20.

Significantly, front cover 16 pivots via front hinge 19 from a generally vertical closed position through an arc of about 270 degrees to a generally horizontal self-stored position beneath and flatly flush with bottom side 6, such that housing 2 is in flat resting contact on the external surface of front cover 16 at bottom side 6. Case 1 may be placed on a flat support surface, e.g. a table or the ground, with the downwardly facing internal surface of self-stored front cover 16 in contact therewith.

Free edge 12 of top cover 11 and free edge 17 of front cover 16 are arranged for interengagement to form a closure seam 22 (FIGS. 2 and 4) when covers 11 and 16 are in the closed position. One or more latches 23 on top cover 11 at free edge 12 engage one or more corresponding locks 24 on front cover 16 at free edge 17 to lock covers 11 and 16 in the closed position for shipping or carrying case 1. Latches 23 and locks 24 may be typical luggage lock parts.

For enhanced structural strength of case 1, and protection of device D from impact damage, housing 2 has integral reinforcing ribs on its longitudinal composite sides, i.e. longitudinal convex ribs or protrusions 25 on top cover 11, the aforesaid longitudinal convex ribs or protrusions 20 on front cover 16 and concave ribs or recesses 21 on bottom side 6, plus longitudinal concave ribs or recesses 26 on rear side 4. Front cover protrusions 20 and bottom side recesses 21 serve together as coacting elements for self storage of front cover 16 and individually as reinforcing and impact protection elements for case 1.

As is clear from FIG. 4, the rear concave rib 26 on bottom side 6 is slightly extended rearwardly at each of the locations therein registering with the locks 24 on the external surface of front cover 16 at top edge 17 when cover 16 is in the stored position. This assures a snug conforming fit between front cover 16 and bottom side 6 at these lock 24 registering locations of the rear concave rib 26, and a flat flush contact between bottom side 6 and front cover 16 when the cover is in the stored position, for flat stable resting of case 1 on a support surface via front cover 16.

Case 1 may have retractable, e.g. telescopically extendible, legs 27 to position housing 2 in elevated relation to the ground or other support surface. Legs 27 are desirably mounted in the recessed vertical corners 28 of housing 2 to protect them from damage during shipping or transport of case 1. Legs 27 are individually adjustable in length to maintain housing 2 level, even when case 1 is used on a beach, picnic area or other uneven surface. Legs 27 may have a captive ball and spring adjustment mechanism coacting with recesses spaced along each telescopic leg extension portion (not shown) to fix each portion releasably to the next for achieving a selective leg length, in known manner.

Rings 29 may be fixedly mounted on lateral sides 7, 8 of housing 2 for connecting the end clips 30 of an adjustable length, detachable strap 31, in conventional manner, for ease in carrying case 1. Strap 31 may be removed when case 1 is shipped.

Figure 6:
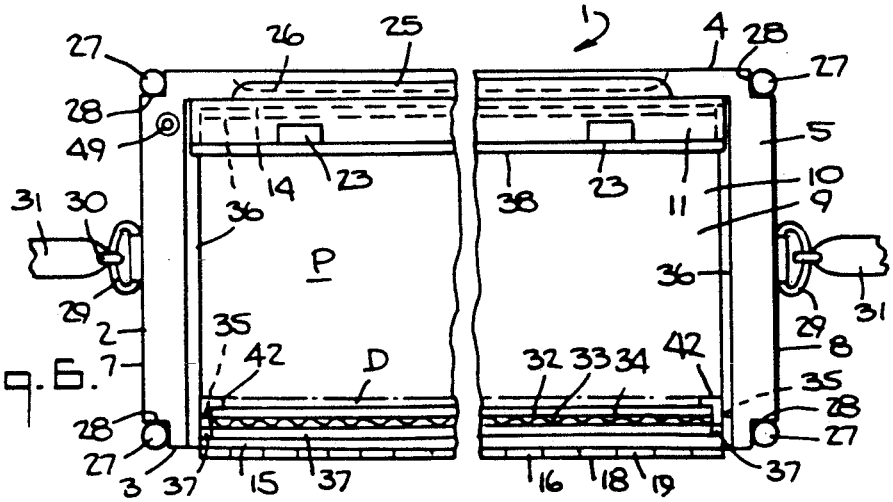
FIG. 6 is a top view corresponding to FIG. 5.
Figure 5:
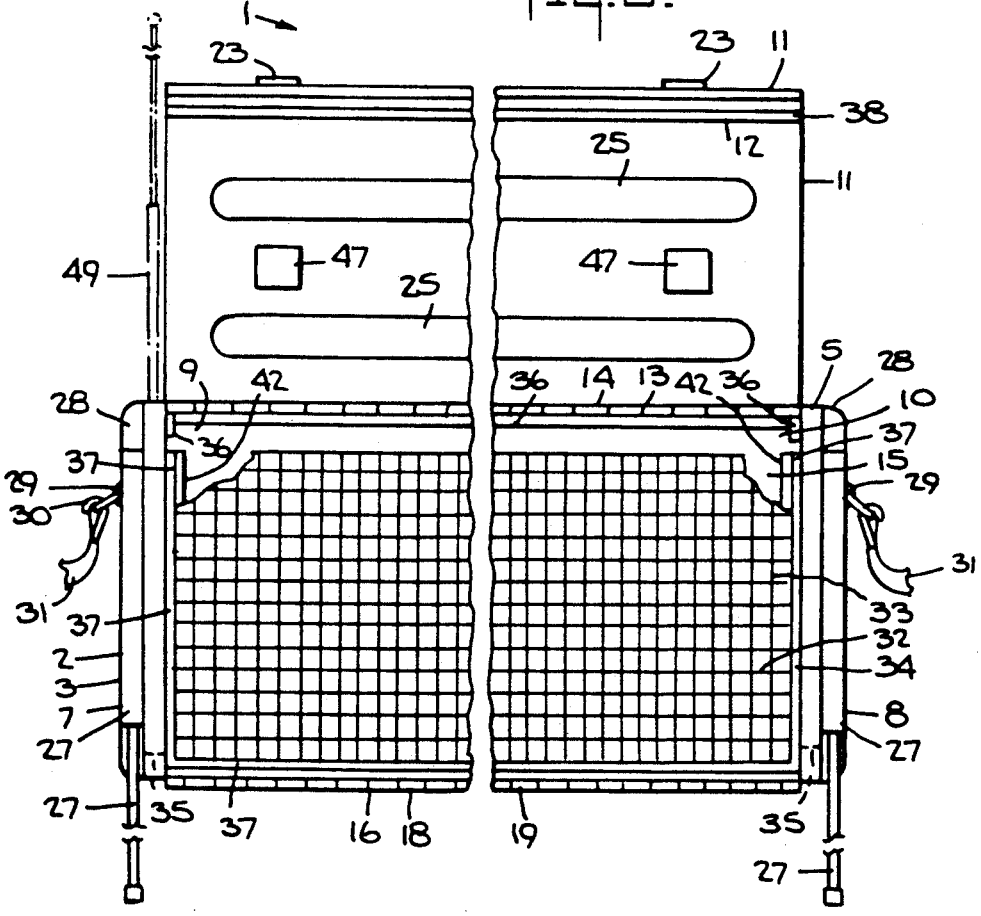
FIG. 5 is a front view of the case with the top cover in an open position and the front cover in self-stored position.

As shown in FIGS. 1, 5 and 6, a dirt-excluding or dirt-impeding acoustically-transparent screen 32 may be arranged in front opening 15 to prevent or impede entry of dust, dirt, e.g. beach sand, etc. that could damage device D, and especially its speakers S, during use, i.e. when front cover 16 is self-stored and top cover 11 is in the closed position protectively covering controls C. Screen 32 may comprise an impact grill 33 covered by a removable acoustically-transparent screening cloth or fabric 34.

Figure 8:
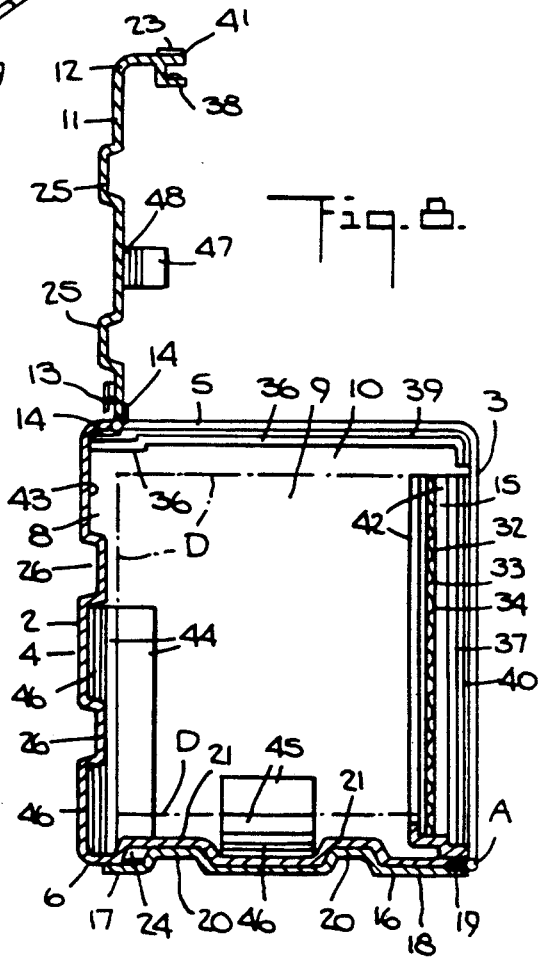
FIG. 8 is a sectional view corresponding to FIG. 5.
Figure 7:
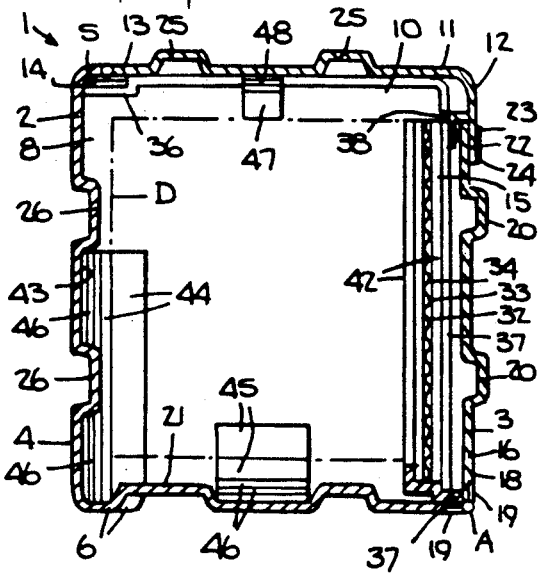
FIG. 7 is a sectional view corresponding to FIG. 4.
Figure 9:
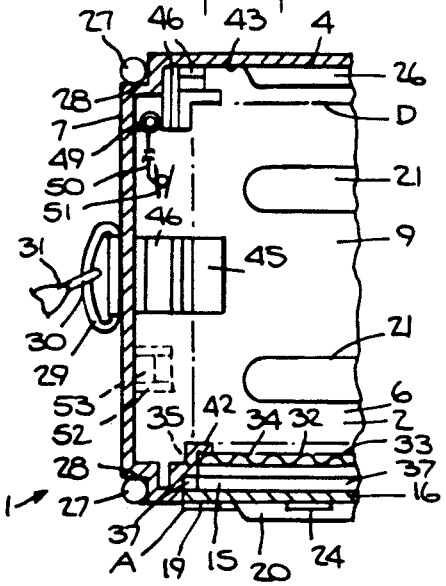
FIG. 9 is a partial sectional view corresponding to FIG. 6.

Referring to FIGS. 7–9, screen 32 is removably positioned in front opening 15 and in recessed relation to front cover 16 when in the closed position. Screen 32 is pivotally mounted via lateral pins 35 (shown in phantom in FIGS. 5, 6 and 9) in front opening 15, i.e. with pins 35 releasably inserted in journal holes in the adjacent portion of front side 3. Screen 32 pivots from an upright, e.g. vertical, closed position (FIGS. 1 and 5–8), forwardly and downwardly to an outward, e.g. horizontal, open position (shown in phantom in FIG. 8) for access to interior 9 via front opening 15 when front cover 16 is self-stored.

As is clear from FIGS. 5–8, top side 5 has a U-shaped top ledge 36 along the opposed lateral edges of top opening 10 adjacent lateral sides 7,8 and along the rear edge of top opening 10 adjacent rear side 4. Ledge 36 is coextensive with and overlaps the adjacent lateral edges and rear edge 13 of top cover 11 and forms a stop that supports top cover 11 in the closed position. Also, front side 3 has a U-shaped front ledge 37 along the opposed lateral edges of front opening 15 adjacent lateral sides 7,8 and along the bottom edge of front opening 15 adjacent bottom side 6. Ledge 37 is coextensive with and overlaps the adjacent lateral edges and bottom edge 18 of front cover 16 and forms a stop that supports front cover 16 in the closed position.

Free edge 12 of top cover 11 has a groove-like recessed ledge 38 that is coextensive with and receives the very slightly inwardly offset flange tip 17*a* of free edge 17 of front cover 16 and forms a floating stop along seam 22 that also supports front cover 16 in the closed position of both covers. Top cover ledge 38 and front cover tip 17*a* correspondingly terminate slightly longitudinally inwardly of the lateral end or corner portions of front edge 12 and top edge 17 that overlap with top ledge 36 and front ledge 37 when top cover 11 and front cover 16 are in the closed position, to permit flush seating of such corner portions against top ledge 36 and front ledge 37 thereat.

As shown in FIG. 8, top ledge 36 has a seal strip 39, front ledge 37 has a seal strip 40 and cover ledge 38 has a seal strip 41, that serve as moisture-excluding or moisture impeding edge-sealing formations or gaskets, disposed along top opening 10, front opening 15 and top cover free edge 12 at seam 22, to seal covers 11 and 16 to housing 2 and to each other when in closed position. Strips 39, 40 and 41 protect interior 9 from dust, dirt, e.g. sand, etc. as well as from moisture, e.g. rain, when case 1 is closed.

Top hinge 14 and front hinge 19 are desirably continuous hinges extending the full length of covers 11 and 16 for maximum structural connection between covers 11 and 16 and housing 2.

As shown in FIG. 8, the longitudinal span of top ledge 36 adjacent rear side 4 underlies top hinge 14 and inwardly overlaps rear edge 13 when top cover 11 is in the closed position, so that the portion of seal strip 39 on that longitudinal span of top ledge 36 assures a moisture-tight seal with the adjacent internal surface of top cover 11 along rear edge 13. Likewise, the longitudinal span of front ledge 37 adjacent bottom side 6 underlies front hinge 19 and inwardly overlaps bottom edge 18 when front cover 16 is in the closed position, so that the portion of seal strip 40 on that longitudinal span of front ledge 37 assures a moisture-tight seal with the adjacent internal surface of front cover 16 along bottom edge 18.

Because of the orthogonal alignment of top cover 11, top hinge 14 and top ledge 36 with front cover 16, front hinge 19 and front ledge 37, when covers 11 and 16 are in the closed position, top edge 17 of front cover 16 at offset tip 17*a* seats precisely against recessed ledge 38 on front edge 12 of top cover 11, so that seal strip 41 on ledge 38 also assures a moisture-tight seal with the adjacent surface of front cover 16 along top edge 17.

As is clear from FIGS. 7-9, front opening 15 has a recessed U-shaped bilateral ledge 42 behind front ledge 37 that serves as a stop for screen 32 and a retainer for the front side of device D in interior 9. When front cover 16 is in self-stored position, and screen 32 is in the upright position in contact with the external side of bilateral ledge 42, top cover 11 may be lowered to the closed position, such that the overhanging curved tip portion constituting front edge 12 outwardly overlies, and preferably slidingly contacts, the top longitudinal margin of screen 32. This overhanging, and preferred contact, relation of top cover 11 with screen 32 protects interior 9 from direct entry of dust, dirt, etc. thereat, when front cover 16 is self-stored during use.

Interior 9 is defined by a perimetric enclosing wall 43, formed of the internal surfaces of front side 3, rear side 4, top side 5, bottom side 6 and lateral sides 7,8. Resilient seating means, such as two resilient pressure pads 44 and two resilient pressure pads 45, are provided in interior 9 for adjustably resiliently seating device D in inwardly spaced relation to wall 43, i.e. at rear side 4, bottom side 6 and lateral sides 7,8, in conjunction with recessed ledge 42 against which the front side of device D seats for inwardly spacing it from front side 3.

The two pads 44 are vertical angular pads located in the left and right rear corners of interior 9 adjacent recessed corners 28 and rear side 4. The two pads 45 are horizontal angular pads located on the left and right sides of interior 9 adjacent lateral sides 7 and 8. Pads 44 and 45 are of selective thickness and interposable between wall 43 and device D, optionally with the use of individual shim elements 46 to adjust the thickness of the pads, and to assure that pads 44 are inwardly spaced from the inwardly projecting sides of concave ribs 26 on rear side 4, and that pads 45 are inwardly spaced from the inwardly projecting sides of concave ribs 21 on bottom side 6 and clear the recessed corners 28 at lateral sides 7,8.

An adhesive may be applied to the outer sides of pads 44 and 45 and/or to shim elements 46, to adhere the pads directly, where they are of sufficient thickness, or via the shim elements, to wall 43. Pads 44 and 45, with or without shims 46, serve to define a perimetric horizontal area matching that of the device D that is to be contained in case 1. In this way, pads 44 and 45, and shims 46 to the extent necessary, can be installed to tailor interior 9 for snug, shock-absorbing reception of device D, so as to contain it in immobilized, protected condition therein.

Internal counterpart resilient seating means, such as two resilient flat pressure pads 47 of selective thickness, are provided on the internal side of top cover 11 for resilient pressure contact with the adjacent top portion of device D when top cover 11 is in the closed position. Pads 47 may be used with individual shim elements 48 to adjust the thickness of the pads, and with an adhesive applied to pads 47 and/or to shim elements 48, to adhere the pads directly or via the shim elements to top cover 11. Pads 47 may be installed at the same time as pads 44 and 45, and are positioned to be clear of controls C on the top side of device D when top cover 11 is in the closed position. When top cover 11 is locked to front cover 16 during shipping or carrying, pads 47 immobilize device D to prevent its lifting away from pads 45 and protect its top side from damage.

Pads 44 and 45, alone or with shim elements 46, and pads 47, alone or with shim elements 48, serve as adjustable seating means for seating a device D of appropriate generally conforming shape and size in interior 9. Pads 44 and 45, alone or with shims 46, space device D inwardly from rear side 4, bottom side 6 and lateral sides 7,8, along with recessed ledge 42 which inwardly spaces device D from front side 3, while pads 47, alone or with shim elements 48, space device D inwardly from top side 5.

When top cover 11 is locked to front cover 16 via latches 23 and locks 24, housing 2 is sealed by strips 38, 40 and 41 against entry of moisture or rain, as well as against entry of sand or other dirt particles, and device D is protectively enclosed and immobilized in case 1 for shipment or transport, inwardly spaced from housing 2 by pads 44, 45 and 47, and by recessed ledge 42, and further protected by top cover ribs 25, front cover ribs 20, bottom side ribs 21 and rear side ribs 26. Due to their resiliency, pads 44, 45 and 47 serve as shock-absorbers between device D and case 1, yet maintain device D immobile therein.

As shown in FIGS. 7 and 9, the horizontal pivot axis A of front hinge 19 is desirably positioned to lie in a vertical plane immediately in front of the vertical plane of front side 3 and of front cover 16 when in the vertical closed position, and to lie in the forward extension of the horizontal plane of bottom side 6. As shown in FIG. 8, this permits unhindered rotation of front cover 16 about axis A through an arc of substantially 270 degrees to the horizontal stored position so that the horizontal plane of front cover 16 lies immediately below the horizontal plane of bottom side 6 and immediately rearwardly of the vertical plane in which axis A is located, for unhindered sound transmission from device D, as well as for flat placement of case 1 on a support.

Housing 2 may have a retractable antenna 49 with a releasable connector, e.g. a wire 50 with an alligator clamp 51, to connect antenna 49 electrically to an intact antenna (not shown) on device D. As shown in FIG. 9, antenna 49 may be mounted in interior 9 adjacent a recessed corner 28, e.g. in the dead space at lateral side 7 between the vertical corner pad 44 and horizontal side pad 45 at the left rear recessed corner 28. Housing 2 may have a conventional gasketed aperture through which antenna 49 extends for use, yet which seals interior 9 against moisture when antenna 49 is retracted into housing 2.

To connect device D to an external power source without removal from case 1, housing 2 may have a port 52 sealed against moisture by a removable gasketed plug 53, e.g. in left lateral side 7 (shown in phantom in FIG. 9), for such connection.

During use, front cover 16 is in self-stored position, yet device D is protected from sand or other dirt by screen 32, as top cover 11 is in the closed position to shield the upper edge of screen 32. To operate controls C on panel P of device D, top cover 11 may be temporarily raised to the open position. As screen 32 is acoustically-transparent, sound emanating from device D is transmitted therethrough in essentially undiminished quality.

It will be understood that while the above embodiment illustrates use of case 1 to contain protectively therein a device D in the form of a portable radio, it may be used to contain any suitable device D such as a portable television set. In this instance, screen 32 will be lowered to the open position or removed entirely to expose the television screen on the front side of device D for viewing through front opening 15.

Housing 2 and covers 11 and 16 are made of suitable structurally rigid plastic of sufficient strength to protect device D from damage when shipping, transporting or manually carrying case 1. These parts are desirably made of impact resistant, moldable, solid plastic such as polyethylene, polypropylene, ABS (acrylonitrile-butadiene-styrene), and the like.

Typically, housing 2 is produced as a hollow molded body by blow molding technique, with ledges 36, 37 and 42 integrally formed thereon. Covers 11 and 16 may be formed as separate plastic pieces, with recessed ledge 38 integrally provided on cover 11 and offset tip 17*a* integrally provided on cover 16. Seal strips 39, 40 and 41, e.g. of rubber gasket material, may be bonded to the corresponding ledges by an adhesive. Hinges 14 and 19, e.g. of known metal type, are typically connected by rivets to housing 2 and covers 11 and 16.

Pads 44, 45 and 47 are suitably made from resilient foam or sponge plastic, and may be formed as composite elements containing a rigid solid plastic backing member and a resilient sponge or foam plastic cushioning member. The backing member is readily bonded by an adhesive to wall 43 directly or via one or more rigid solid plastic shim elements 46 or 48 as the case may be.

The invention thus provides a protective case for shipping and for using in place therein a portable sound-playing device such as an audio or video unit, at reduced risk of damage from impact during shipping and carrying, and from moisture and dirt, yet permitting unhindered use of the device in the case while normally protecting it from dirt. The case is simple and inexpensive in construction, readily fabricated, and robust, rugged and long wearing in use.

The specification and drawings are set forth by way of illustration and not limitation, and various modifications may be made therein without departing from the spirit of the invention which is to be limited solely by the scope of the claims.

What is claimed is:

1. Protective case for shipping and for using in place therein a portable sound-playing device, comprising a housing resembling a rectangular box, and having a front side, a rear side, a top side, a bottom side and opposed lateral sides forming a hollow interior adapted to receive protectively such a portable sound-playing device, the top side having a top opening between the lateral sides that is closed by a top cover having a front edge and a rear edge, the front edge defining a free edge and the rear edge being hinged to the housing adjacent the rear side to pivot the top cover from a closed position upwardly and rearwardly to an open position to insert such a portable sound-playing device into the interior, the bottom side having an external recess, the front side having a front opening between the lateral sides that is closed by a front cover having an external protrusion releasably engageable in the recess, the front cover further having a top edge and a bottom edge, the top edge defining a free edge and the bottom edge being hinged to the housing adjacent the bottom side to pivot the front cover from a closed position forwardly and downwardly and then rearwardly and upwardly to a self-storing position generally parallel to the bottom side and in which the protrusion engages the recess, for unhindered sound transmission from such a portable sound-playing device via the front opening after such a portable sound-playing device has been inserted into the interior of the housing, the free edge of the top cover and the free edge of the front cover being arranged for interengagement to form a closure seam when the covers are in the closed position, and moisture-impeding edge-sealing formations disposed along the top opening, front opening and one of the free edges forming the seam to seal the covers to the housing and to each other when in the closed position.

2. Case of claim 1 wherein the interior is defined by a perimetric enclosing wall, and resilient seating means are provided for adjustably resiliently seating such a portable sound-playing device in inwardly spaced relation to the enclosing wall.

3. Case of claim 2 wherein the seating means include resilient shock-absorbing pressure pads of selective thickness interposable between the enclosing wall and such a portable sound-playing device after such a portable sound-playing device has been inserted into the interior of the housing.

4. Case of claim 3 wherein individual shim elements are included to adjust the thickness of the pads.

5. Case of claim 2 wherein an internal counterpart resilient seating means is provided on the top cover for resilient shock-absorbing pressure contact with the adjacent top portion of such a portable sound-playing device when the top cover is in the closed position.

6. Case of claim 1 wherein the protrusion is arranged for friction-fit engagement with the recess.

7. Case of claim 6 wherein the recess is a longitudinal groove and the protrusion is a counterpart longitudinal ridge.

8. Case of claim 1 wherein a dirt-impeding acoustically-transparent screen is arranged in the front opening to impede entry of dirt when the front cover is in the self-storing position and the top cover is in the closed position.

9. Case of claim 8 wherein the screen is removably positioned in the front opening and in recessed relation to the front cover when in the closed position.

10. Case of claim 9 wherein the screen is pivotally mounted in the front opening to pivot from an upright closed position forwardly and downwardly to an open position for access to the interior when the front cover is in the self-storing position.

11. Case of claim 8 wherein the screen comprises an impact grill covered by an acoustically-transparent screening fabric.

12. Case of claim 1 wherein a retractable antenna is provided in the housing and releasable connector means are provided for electrically connecting said antenna to an intact antenna on such a portable sound-playing device after such a portable sound-playing device has been inserted into the interior of the housing.

13. Case of claim 1 wherein retractable legs are provided on the housing to position the housing in elevated relation to a support surface.

14. Case of claim 13 wherein the legs are telescopically selectively extendible legs.

15. Protective case for shipping and for using in place therein a portable sound-playing device, comprising a housing resembling a rectangular box, and having a front side, a rear side, a top side, a bottom side and opposed lateral sides forming a hollow interior adapted to receive protectively such a portable sound-playing device, the interior being defined by a perimetric enclosing wall, the top side having a top opening between the lateral sides that is closed by a top cover having a front edge and a rear edge, the front edge defining a free edge and the rear edge being hinged to the housing adjacent the rear side to pivot the top cover from a closed position upwardly and rearwardly to an open position to insert such a portable sound-playing device into the interior, the bottom side having an external recess, the front side having a front opening between the lateral sides that is closed by a front cover having an external protrusion releasably engageable in the recess, the front cover further having a top edge and a bottom edge, the top edge defining a free edge and the bottom edge being hinged to the housing adjacent the bottom side to pivot the front cover from a closed position forwardly and downwardly and then rearwardly and upwardly to a self-storing position generally parallel to the bottom side and in which the protrusion engages the recess, for unhindered sound transmission from such a portable sound-playing device via the front opening after such a portable sound-playing device has been inserted into the interior of the housing, the free edge of the top cover and the free edge of the front cover being arranged for interengagement to form a closure seam when the covers are in the closed position, moisture-impeding edge-sealing formations disposed along the top opening, front opening and one of the free edges forming the seam to seal the covers to the housing and to each other when in the closed position, resilient seating means in the interior for adjustably resiliently seating such a portable sound-playing device in inwardly spaced relation to the enclosing wall, including resilient shock-absorbing pressure pads of selective thickness interposable between the enclosing wall and such a portable sound-playing device, and an internal counterpart resilient seating means on the top cover for resilient shock-absorbing pressure contact with the adjacent top portion of such a portable sound-playing device when the top cover is in the closed position.

16. Case of claim 15 wherein a dirt-impeding acoustically-transparent screen is arranged in the front opening to impede entry of dirt when the front cover is in the self-storing position and the top cover is in the closed position.

17. Case of claim 15 wherein a retractable antenna is provided in the housing and releasable connector means are provided for electrically connecting said antenna to an intact antenna on such a portable sound-playing device after such a portable sound-playing device has been inserted into the interior of the housing.

18. Case of claim 15 wherein retractable legs are provided on the housing to position the housing in elevated relation to a support surface.

* * * * *